US005112017A

United States Patent [19]

Pang

[11] Patent Number: 5,112,017

[45] Date of Patent: May 12, 1992

[54] HOLDER FOR A BEAKER CONTAINING A DRINK

[76] Inventor: Hian S. Pang, 7 Watten Drive, Singapore, Singapore, 1128

[21] Appl. No.: 671,405

[22] Filed: Mar. 19, 1991

[30] Foreign Application Priority Data

Mar. 19, 1990 [EP] European Pat. Off. ..... 90302940.3

[51] Int. Cl.[5] ..... A47K 1/08

[52] U.S. Cl. ..... 248/311.2; 248/146

[58] Field of Search ..... 248/311.2, 313, 314, 248/146, 346.1, 318, 315, 310, 309.1; 220/85 H, 903

[56] References Cited

U.S. PATENT DOCUMENTS 2,666,310 1/1954 Hill ..... 248/146
4,069,996 1/1978 Koziol ..... 248/146
4,526,124 7/1985 Hartwall ..... 248/311.2 X
4,596,370 6/1986 Adkins ..... 248/311.2
4,993,611 2/1991 Longo ..... 248/311.2 X

*Primary Examiner*—Ramon O. Ramirez
*Attorney, Agent, or Firm*—Fleit, Jacobson, Cohn, Price, Holman & Stern

[57] ABSTRACT

The present invention comprises a holder (2) for a beaker (10) containing a drink, in the form of a hollow cylindrical body for receiving said beaker which leaves a gap (12) between the beaker and the body thereby allowing a through-flow of air across the surface of the beaker. The hollow cylindrical body may include a number of protrusions (14) or sticky strips (16) in order to provide sufficient friction between the beaker and the holder. The body may be fabricated from the relatively rigid or relatively soft material. Using the holder enables the drink to be drunk at its proper temperature. Furthermore, it is simple, inexpensive and reuseable.

10 Claims, 1 Drawing Sheet

HOLDER FOR A BEAKER CONTAINING A DRINK

The present invention is directed towards a holder for a beaker containing a drink and in particular, but not exclusively, to a holder for a beaker containing either a hot or cold drink.

Non-insulated beakers containing hot or cold drinks can be difficult to handle and/or drink. In most cases, the drink has to be allowed to either cool down or warm up before partaking of the drink. Otherwise, due to the temperature difference being transferred through the non-insulated beaker, a user may suffer discomfort through the beaker being either too hot or too cold. In addition, condensation may form on the outside of the non-insulated beaker which can be either messy or dangerous for a user.

Insulated beakers are known in the art but have to be specifically manufactured.

An aim of the present invention is to provide a holder for a beaker which is simple, easy to use and applicable to any shape or size of glass.

According to the present invention there is provided a holder for a beaker containing a drink comprising a hollow cylindrical body for receiving said beaker and characterised by a gap between said beaker and said body thereby allowing a through-flow of air across the surface of the beaker.

Preferred features of the present invention are defined in the appended dependent claims.

By way of example only, embodiments of the present invention will now be described with reference to the accompanying drawings, of which:

Figure 1:
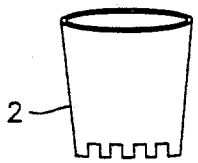
FIG. 1 is a schematic diagram of a basic embodiment of the present invention.
Figure 2:
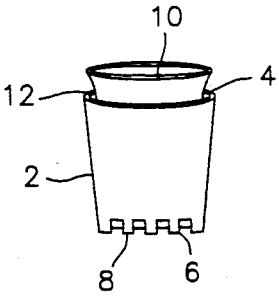
FIG. 2 is a schematic diagram of the holder illustrated in FIG. 1 having a beaker disposed therein.

The basic form of the present invention as illustrated by the first embodiment in FIGS. 1 and 2 comprises a hollow cylindrical body (2). The body (2) has an open upper end (4) and an open lower end (6) having a series of castellations (8) depending therefrom.

The cylindrical body (2) maybe manufactured in various shapes and sizes to suit a beaker (10). The body (2) is dimensioned so that a small gap (12) is left between the beaker (10) and the body (2). This allows a through-flow of air over the surface of the beaker (10).

If the beaker (10) contains a hot drink, then cold air will rise through the open bottom (6) over the surface of the beaker (10) and out through gap (12) at the open end (4) of the body (2). If the beaker (10) contains a cold drink, the flow of air through the gap (12) will be reversed. The through-flow of air in either case will be accentuated as the holder (2) and beaker (10) are moved, for example when the drink is being drunk.

Figure 3:
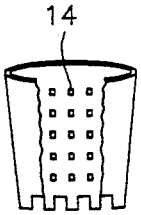
FIGS. 3 and 4 illustrate second and third embodiments of the present invention.
Figure 4:
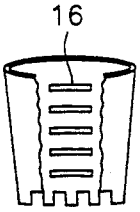

If the beaker has a particularly smooth surface, for example when the beaker is fabricated from glass, the holder (2) may include a number of protusions (14) or sticky strips (16) as shown by the second and third embodiments illustrated in FIGS. 3 and 4.

If a substantially cylindrical beaker is used, then the holder may be fabricated from a rigid or a relatively soft material. However, if the beaker is substantially straight, the holder must be fabricated from a relatively soft, flexible material.

Figure 5:
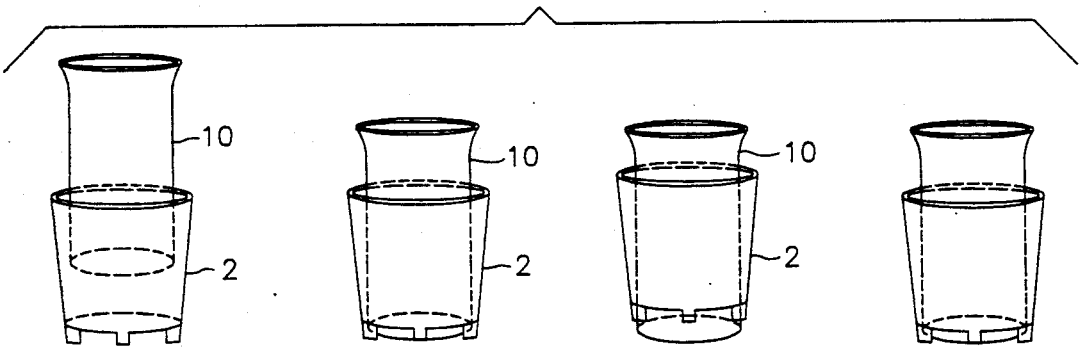
FIG. 5 illustrates a fourth embodiment of the present invention.

FIG. 5 illustrates a substantially cylindrical container with a relatively rigid holder. A beaker (10) is inserted into the holder (2) as shown in FIG. 5(*a*). When lifting the holder (2), the beaker (10) will initially stay in contact with the surface on which it is sitting, as shown in FIGS. 5(*b*) and (*c*). When the brim of the holder contacts the beaker, then the beaker will be retained in position and lifted together with the holder. On returning the holder (2) surface, the beaker initially touches the surface and then the holder drops down also to rest on the surface, as shown in FIG. 5(*d*).

Figure 6:
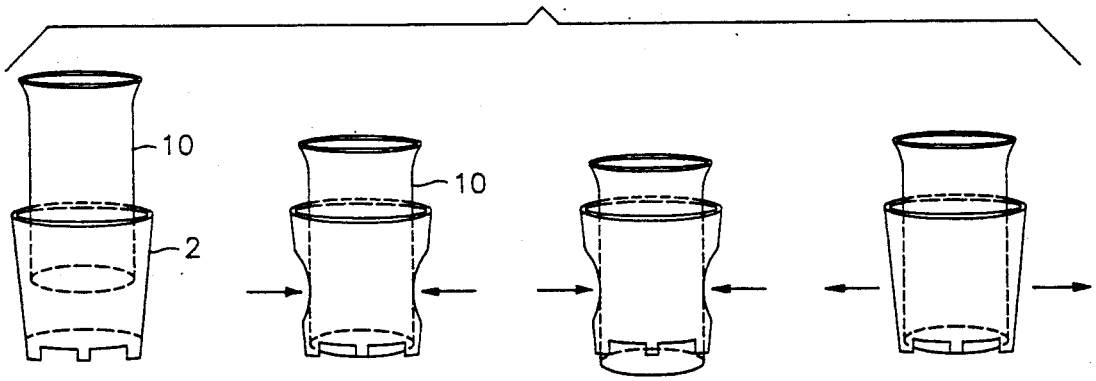
FIG. 6 is an illustration of a fifth embodiment of the present invention.
Figure 7:
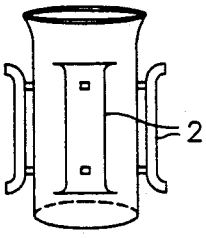
FIG. 7 is a schematic diagram of a sixth embodiment of the present invention.

FIG. 6 illustrates substantially straight container with a relatively soft holder. Initially, the beaker is placed in the holder as shown in FIG. 6(*e*). On taking a drink, pressure is first applied to the holder so that it concaves inwards to touch the outer surface of the beaker, as shown in FIG. 6(*f*). The holder and beaker are then lifted up together, as shown in FIG. 6(*g*), and on returning the drink to its surface, the holder assumes its original shape, as shown in FIG. 6(*h*).

The holder (2) can also be fabricated from a number of straps attached to the surface of the beaker. However, this embodiment dictates that the holder shall be integral with the beaker and is therefore not reuseable.

Figure 8:
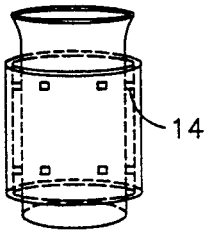
FIG. 8 is a schematic diagram of a seventh embodiment of the present invention.

The final embodiment as shown in FIG. 8, comprises a cylindrical body having a number of protusions (14) for attaching or afixing the beaker to the holder. Since the protusions (14) are relatively small, little heat radiates to the holder thus still enabling the aforementioned advantages to be attained.

The aforegoing description of the present invention has been given by way of example only and a person skilled in the art would appreciate the modifications maybe made without parting from the scope of the present invention.

I claim:

1. A holder for a rigid beaker containing a drink, comprising:

hollow cylindrical body means for receiving said rigid beaker, for grasping the beaker to drink therefrom, and for insulating the grasping of the beaker to prevent discomfort of a user drinking from the beaker; and convection means for providing through-flow of air when the beaker is contained in the holder moving from the ambient environment, across the surface of the beaker upwardly when the beaker contains a hot drink and downwardly when the beaker contains a cold drink, and then back into the ambient environment.

2. A holder as claimed in claim 1 in which said body means includes a number of castellations disposed at one end for allowing a through-flow of air when the holder is positioned on a surface.

3. A holder as claimed in claim 1, in which said body, means includes a number of protrusions disposed on the inner surface of the body means for increasing the friction between the holder and the glass.

4. A holder as claimed in claim 1, in which said body means includes a means for temporarily sticking said beaker to said holder whereby said means are disposed on the inner surface of the body means.

5. A holder as claimed in claim 1, in which said body is fabricated from a material sufficiently flexible for bending to provide secure grasping of the beaker which is more rigid than the body.

6. The holder of claim 1 further including reusable means for removing the beaker from the body and for replacing another beaker into the body and, in which convection means includes a gap between the beaker and the body.

7. The holder of claim 1, further including flexibility means for allowing different sizes and shapes of beakers to be received into the body for securely grasping the beaker for drinking therefrom, and for removing the beaker for reusing the holder.

8. A holder for a beaker containing a drink comprising a hollow cylindrical body for receiving said beaker and characterized by a gap between said beaker and said body thereby allowing a through-flow of air across the surface of the beaker in which said body is characterized by a number of castellations disposed at one end for allowing a through-flow of air when the holder is positioned on the surface.

9. A holder for a beaker containing as drink comprising a hollow cylindrical body for receiving said beaker and characterized by a gap between said beaker and said body thereby allowing a through-flow of air across the surface of the beaker in which said body is characterized by a number of protrusions disposed on the inner surface of the body for increasing the friction between the holder and the beaker.

10. A holder for a beaker containing a drink comprising a hollow cylindrical body for receiving said beaker and characterized by a gap between said beaker and said body thereby allowing a through-flow of air across the surface of the beaker in which said body is characterized by a means for temporarily sticking said beaker to said holder whereby said means are disposed on the inner surface of the body.

* * * * *